United States Patent [19]

Bryant

[11] Patent Number: 4,803,746

[45] Date of Patent: Feb. 14, 1989

[54] METHOD AND APPARATUS FOR APPLYING A RANDOM SPECKLED DYE PATTERN TO CARPET MATERIAL AND THE LIKE

[75] Inventor: Clifford A. Bryant, Dalton, Ga.

[73] Assignee: WestPoint Pepperell, West Point, Ga.

[21] Appl. No.: 176,927

[22] Filed: Apr. 4, 1988

[51] Int. Cl.[4] ..... D06B 1/02; D06B 11/00

[52] U.S. Cl. ..... 8/151; 8/158; 68/205 R; 118/315; 118/323; 239/224; 427/256; 427/288; 427/421

[58] Field of Search ..... 8/151, 158; 68/205 R; 427/31, 256, 288, 421; 118/315, 323, 626; 239/223, 224, 751, 752, DIG. 1

[56] References Cited

U.S. PATENT DOCUMENTS

| | | | |
|---|---|---|---|
| 1,022,956 | 4/1912 | Lengerke et al. | 239/224 X |
| 3,147,137 | 9/1964 | Glass et al. | 118/626 X |
| 3,903,715 | 9/1975 | Plotz | 68/205 R |
| 4,282,729 | 8/1981 | Smith | 68/205 R |
| 4,338,876 | 7/1982 | Norton | 68/205 R X |

FOREIGN PATENT DOCUMENTS

| | | |
|---|---|---|
| 215096 | 10/1909 | Fed. Rep. of Germany . |
| 222192 | 5/1910 | Fed. Rep. of Germany . |

*Primary Examiner*—Philip R. Coe
*Attorney, Agent, or Firm*—Schweitzer & Cornman

[57] ABSTRACT

A method and apparatus for applying a random, speckled pattern of dye to a moving web, such as carpeting. A series of closely spaced distributor units are mounted over the top surface of the web, and each carries a rotating disc, onto which dye material is flowed at a controlled rate. The rotating discs are formed with a highly irregular peripheral contour, such that a high degree of variability and randomness is imparted to the size and trajectory of the atomized dye particles. A significantly improved appearance of randomness in the speckled pattern is achieved.

8 Claims, 2 Drawing Sheets

11
29
13
12
20
14a
17
16a
18
14
19
15
28
27
4
4
21
24
23
25
26
22
33
10

3
3
11
12
13
18
29
20
16a
17
28
14a
19
15
14
27
22
26
23
25
33
10

METHOD AND APPARATUS FOR APPLYING A RANDOM SPECKLED DYE PATTERN TO CARPET MATERIAL AND THE LIKE

BACKGROUND AND SUMMARY OF THE INVENTION

In the manufacture of carpeting and similar web materials, it is frequently desirable to apply dyes to the web surface in the form of random speckled patterns. For this purpose, it is known to utilize rotating disk distributors, arranged to discharge droplets of liquid dye stuff from the peripheral edge of the disc, by centrifugal force. In the arrangement of the Plotz, U.S. Pat. No. 3,903,715, for example, discs are arranged horizontally over a travelling web of carpet material, and the droplets of dye liquor are discharged horizontally from rotating distribution discs and are allowed to fall by gravity onto the surface of the moving carpet web. A somewhat different arrangement is illustrated in the Norton U.S. Pat. No. 4,338,876, in which distributor discs, rotating about vertical axes are arranged adjacent a vertically moving web of material, such that the centrifugally discharged droplets are impelled against the fabric surface by reason of their discharge velocity.

A shortcoming of known arrangements for the random speckled coating of carpeting and other web materials lies in the inability to achieve a desirable level of randomness in the overall design. Typically, the web material being processed is relatively wide, and several dispensing discs are required to cover the full width of the material. These necessarily are arranged so that the areas of coverage of adjacent distributing devices overlap somewhat and, with conventional equipment, there is sufficient regularity in the "random" distribution, that there is a streakiness to the finished product.

The present invention is directed to improvements in equipment and techniques for the application of dye liquid to carpeting and other web materials in a random, speckled pattern, whereby to significantly improve the true randomness of the application and to significantly minimize any tendency towards streaking because of overlapping coverage. To this end, random distribution of a speckled dye pattern across the full width of a moving web is provided by means of a large number of closely spaced, rotating distribution discs, arranged for rotation about vertical axes. Pursuant to the invention, the rotating discs are of a highly irregular peripheral contour, so that there is wide variation in the radial and tangential velocity of individual droplets of dye liquor discharged from different areas on the rotating discs. In addition, the sizes of the individual droplets of dye liquor will vary as a function of the disc radius at the point of discharge of the droplet. Accordingly, there is introduced a highly desirable degree of randomness in droplet sizes, as well as in the distribution. For a more complete understanding of the above and other features and advantages of the invention, reference should be made to the following detailed description of preferred embodiments of the invention, and to the accompanying drawings.

DESCRIPTION OF PREFERRED EMBODIMENTS OF THE INVENTION

Figures 1, 4A, 4B:
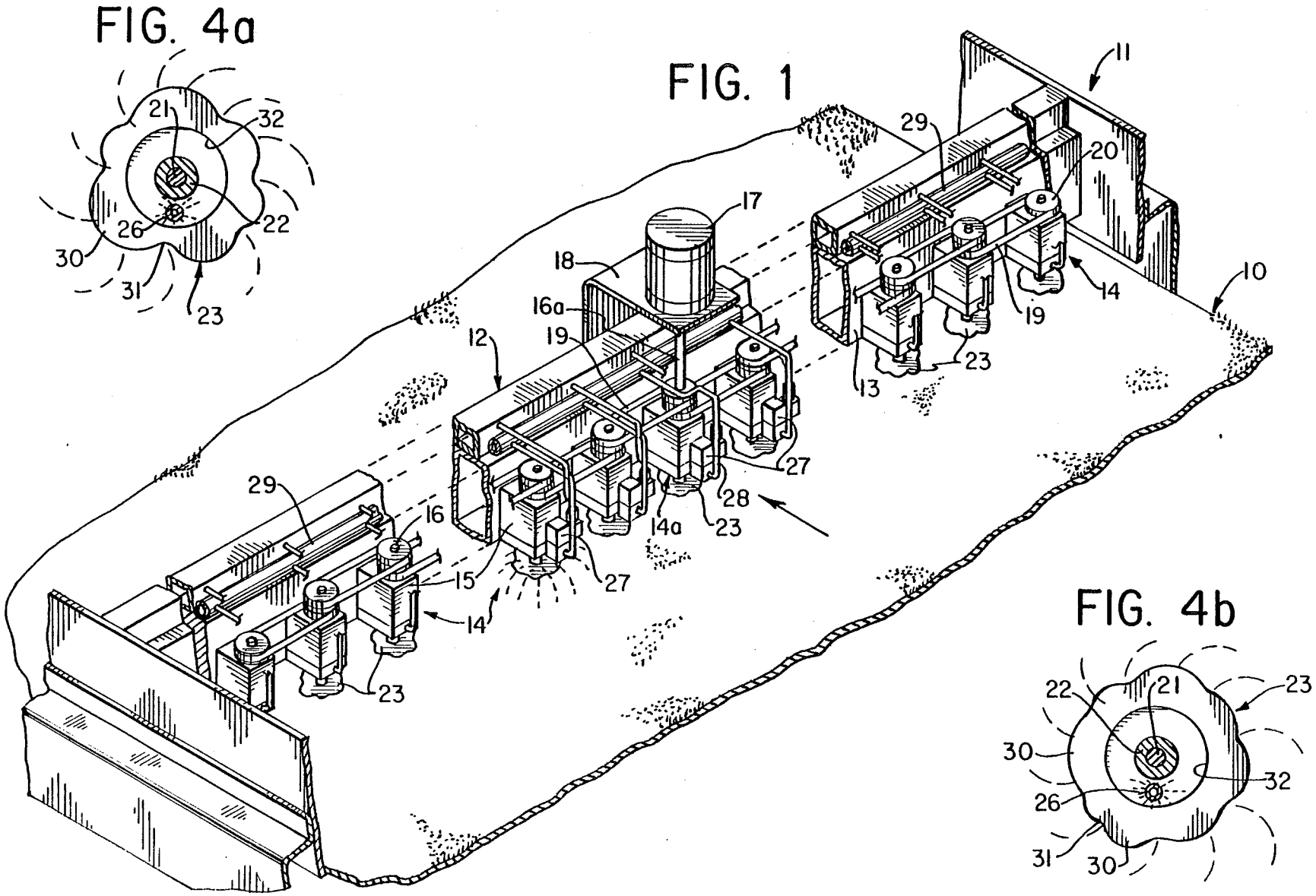
FIG. 1 is a fragmentary, perspective view, partly in section, illustrating an apparatus constructed in accordance with the invention for the application of a random, speckled dye pattern to the surface of a moving carpet web.
FIGS. 4*a* and 4*b* are cross-sectional views, as taken on Line 4—4 of FIG. 3, illustrating typical forms of distribution discs utilizing the practice of the invention.

Referring now to the drawing and initially to FIG. 1 thereof, the reference numeral 10 designates a web of carpeting material being advanced longitudinally through a treating station 11 for the application of random, speckled dye pattern. Any appropriate conveyor means (not shown) may be used for this purpose. At the treating station, there is mounted an elongated tubular structural beam 12, which is mounted at opposite sides of the station 11 and extends transversely across and slightly above the upper surface of the web.

Mounted on the upstream face 13 of the structural beam 12 are a plurality of distributor units, generally designated by their reference numeral 14. These units are arranged in closely spaced relation across the full width of the carpet web 10 (which in a typical case may be 12 feet). In an advantageous embodiment of the invention, the distributor units 14 are spaced apart on 6 inch centers across the width of the web, with units being arranged sufficiently close to the selvages of the carpet to provide adequate distribution of the dye material at the edge extremities.

Figure 3:
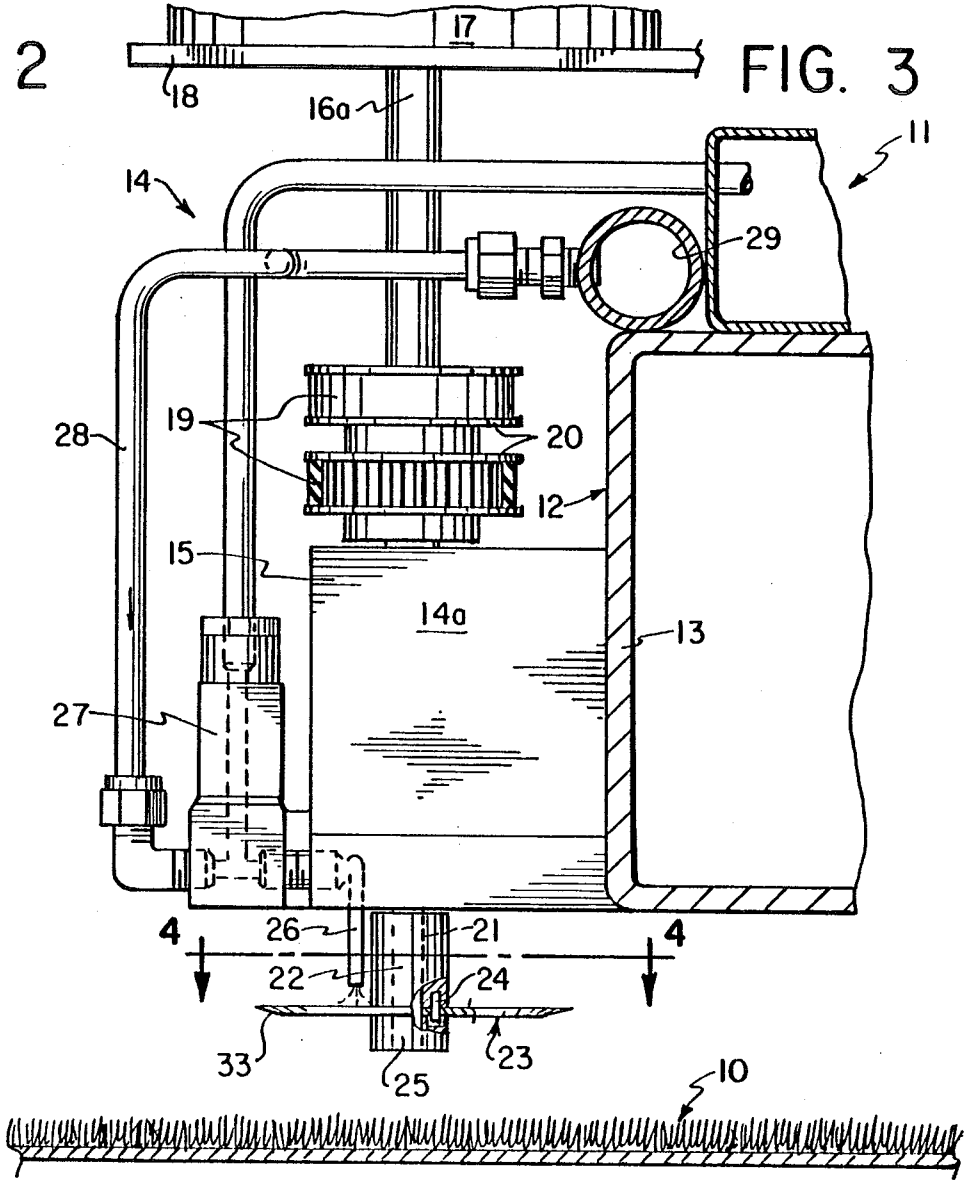
FIG. 3 is a cross-sectional view, as taken on Line 3—3 of FIG. 2.
Figure 2:
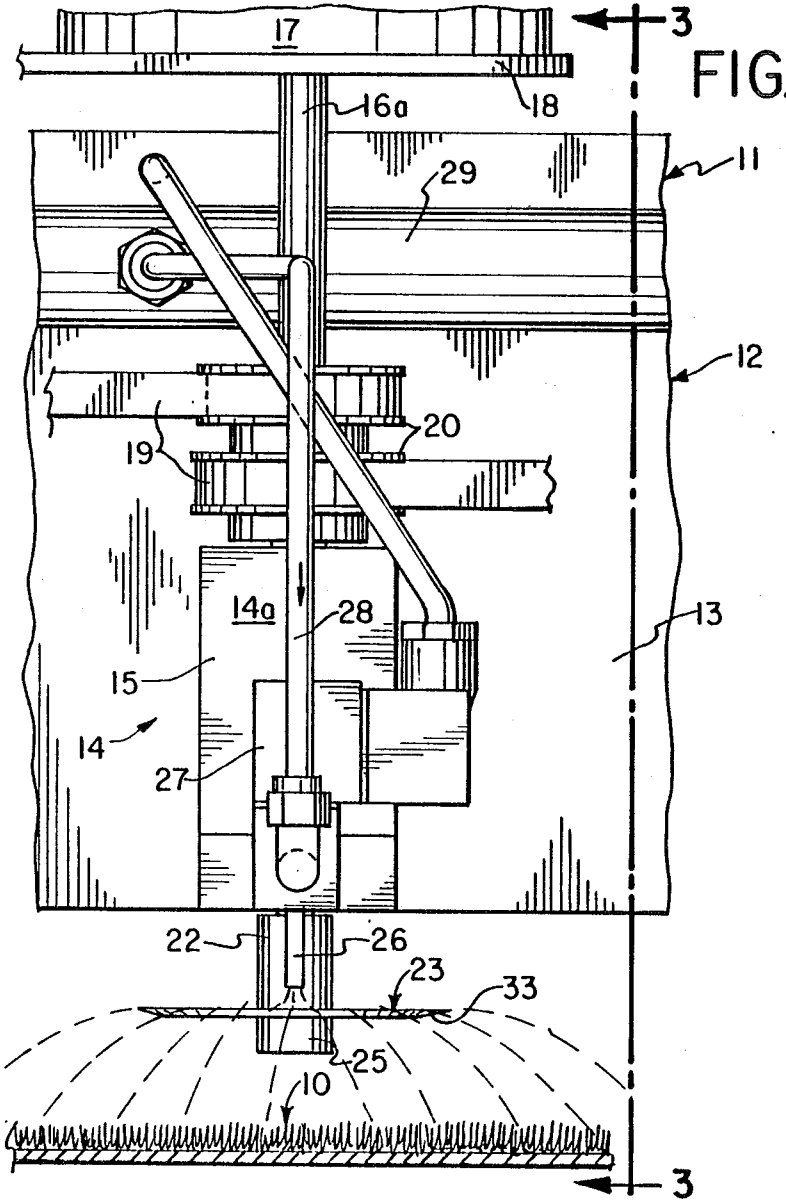
FIG. 2 is an enlarged, fragmentary, front elevational view of an individual applicator device of the apparatus of FIG. 1.

In the illustrated arrangement, each of the distributor units 14 (shown in more detail in FIGS. 2 and 3) includes a housing 15 incorporating bearings (not shown) for journalling a vertically oriented shaft 16 having portions extending above and below the housing 15. Advantageously, one of the shafts 16*a* (see FIG. 1) has an extension connected to a drive motor 17 mounted by a bracket 18 from the main structural beam 12. In the illustrated arrangement, the motor 17 drives one of the distributor units 14*a* in the middle of the series thereof, while the other distributor units are driven by means of a series of gear belts 19 and gear pulleys 20. If desired, of course, the several distributor units could be individually driven.

On the lower extension 21 of the shaft 16, there is mounted a drive collar 22, the lower end face of which forms an abutment shoulder for positioning of a distributor disc 23. The disc 23 has a central aperture for receiving the shaft 21, and also has a small aperture for receiving a drive pin 24. A retaining collar 25 is secured to the shaft extension below the disc 23, so that the disc is clamped tightly between the sleeves 22, 25.

A dispensing tube 26 for the dye liquor extends downward from the distribution housing 15, terminating a short distance (e.g. one-fourth inch) above the surface of the disc. The tube 26 is connected through a solenoid valve 27 and supply tube 28 to a header pipe 29. The header pipe is mounted on the top of the main structural beam 12 and extends across the full width of the apparatus. The header is supplied with the dye liquid and has individual connections for the several distributing units 14. The several solenoid valves 27 desirably are actuated in unison by appropriate conventional control means (not shown). Also, each solenoid valve 27 may be activated by a pattern device (computerized if desired) to form controlled areas of dye droplets. Each supply tube may have a separate adjustable flow control valve (not shown) for regulating the rate of flow of the dye to the associated disc.

To advantage, the distribution discs 23 have a nominal radius of approximately one and five-eighths inches. In accordance with the invention, however, the peripheral contour of the disc is highly irregular, such that the minimum radius may be considerably less than the maximum radius. In a typical disc configuration, such as shown in FIG. 4*a* of the drawing, the disc 23 may have a plurality of rounded lobes 30, which may be of different size and shape, and may differ in maximum radius. These lobes are separated by recess areas 31, in which the radius of the disc may be significantly less than that at the maximum radius areas of the lobes 30. For example, the maximum radius at any point may be about 1.6 inches and the minimum radius at any point may be about 1.0 inch.

In the version of FIG. 4*a*, the recess areas 31 are very distinct, and some or all of them may be rather sharply configured, in the form of shallow "V"'s, for example. In a somewhat different version, shown in FIG. 4*b*, the peripheral contour of the disc is highly irregular, but with a less distinct pattern of lobes and recess areas. In the different disc modification shown in FIGS. 4*a* and 4*b*, the maximum and minimum radii may be approximately the same (e.g. max. radius about 1.6 inches, min. radius approximately 1.0 inch), but the pattern of lobes and recesses is less distinct in the version of FIG. 4*b*. As will be understood, the variety of disc configurations is virtually limitless, within the conceptual principal of providing for a significant variation between maximum and minimum radius throughout the peripheral contour of the disc.

In an advantageous form of the invention, a series of distributor units 14 mounted on six inch centers and utilizing irregular discs of about 1.6 inch nominal maximum radius, the discs are desirably driven at speeds of from about 400 r.p.m. to about 1200 r.p.m., depending upon the viscosity of the dye liquor utilized. Typically, the dye liquor will be formulated to have a viscosity in the range of about 600 to about 3,000 c.p.s. The dye liquor is deposited on the upper surfaces of the discs 23 as close as practicable to the sleeve 22. To advantage, the upper surface of each disc 23 is provided with a recess 32 of a depth of one thirty-second–one-sixteenth inch. The inflowing dye liquid is initially momentarily confined within the recess 32, which optimizes the distribution of the liquid on the surface of the rotating disc.

In accordance with known principals, the peripheral edges of the discs desirably are beveled upward from the lower surface, as indicated at 33, to provide a relatively sharp peripheral edge for better droplet formation. In addition, the upper surface of each disc may be randomly roughened or texturized to randomly inhibit the outward flow of dye liquid across the surface of the disc under centrifugal force.

In the operation of the apparatus described, the carpet web 10 is advanced through the treating station 11 at an appropriate speed. The drive motor 17 is actuated, as are the solenoid valves 27 associated with each of the distributing units. Dye liquid flows onto the upper surfaces of each of the plurality of discs 23 and is caused to flow radially outward thereon by the centrifugal forces imparted by the disc rotation because of the irregular peripheral configuration of the discs, liquid reaches different peripheral edge regions after different periods of residence on the disc surface. As the liquid reaches the edge areas, it is discharged by the action of centrifugal force. A liquid being discharged from relatively small radius areas will tend to form relatively larger droplets in the atomizing process. In addition, the droplets being discharged from areas of smaller radius are discharged with lower radial and tangential velocities, so that their trajectory and impact patterns differ correspondingly from droplets discharged from regions of larger disc radius.

As will be readily understood, the relationships of rotational speed and dye viscosity are so adjusted that the distributional radius of a adjacent units substantially overlap, so that the entire surface of the carpet web 10 is treated. By opening and closing solenoid valves 27 by means of a patterning device as the carpet passes under the dye treating station 11, uneven areas of dye droplets widthwise and lengthwise will be formed. Using two or more dye bars at the treating station 11 using a patterning device a multicolor patterning of the dye droplets will be formed widthwise and lengthwise. The pattern may be controlled by mechanical or electrical means, or may be computerized.

Desirably, although not necessarily, all of the discs of a given installation will be of similar peripheral configuration, as a matter of manufacturing convenience. However, as will be readily understood, the rotational orientation of individual discs will tend to be relatively random, each disc with respect to its neighboring discs, so that a significant degree of randomness is assured in areas where the distributional patterns overlap. Of course, where desired, individual distributor units may be fitted with discs of different configuration.

The apparatus and procedure of the invention provide for a particularly high degree of randomness in the distribution of droplets of dye liquid, resulting from the centrifugal action of the distributor discs 23. Both the size of the droplets and their trajectory are randomly variable, as a function of the different radial and tangential velocities of the droplets as they are discharged from different peripheral areas of the disc. The resulting speckled pattern is of a highly random nature, significantly free of the longitudinal streakiness which has characterized web materials treated by conventional apparatus and procedures.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. Apparatus for applying liquid material to a moving web in a random speckled pattern, which comprises (a) means for advancing a web of material to be treated, (b) support means extending across the width of said web, (c) a plurality of distributor units mounted on said support means, (d) each of said distributor units mounting a shaft and (e) distributor disc, drive means for rotating said shafts, (f) means for flowing said liquid material onto the surfaces of said discs, during rotation thereof, to effect centrifugal atomization and distribution of said liquid, (g) said discs being formed with a randomly irregular peripheral contour, whereby said atomization and distribution is in a randomly speckled pattern.

2. Apparatus according to claim 1, further characterized by (a) said discs being arranged in close adjacency, whereby the distributional patterns of adjacent distributor units are substantially overlapping, and (b) the peripheral contours of one disc are randomly irregular relative to the peripheral contours of an adjacent disc.

3. Apparatus according to claim 2, further characterized by (a) each disc of a plurality thereof is of similar peripheral configuration, and (b) the rotational orientation of said discs, each with respect to any adjacent disc, is a random function.

4. Apparatus according to claim 1, further characterized by (a) said distributor units each having a supply duct for discharging liquid on the upper surface of the disc, adjacent to said shaft, (b) said discs being provided, in the region adjacent said shafts, with an annular recess for receiving liquid material.

5. Apparatus according to claim 1, further characterized by (a) said discs being formed with a flat, randomly textured upper surface.

6. Apparatus according to claim 1, further characterized by (a) said web being carpeting material, (b) said distributor units being spaced on approximately six inch centers across the width of said fabric, (c) said discs being approximately three inches in maximum diameter, (d) said drive means rotating said discs at a speed of from about 400 to about 1200 r.p.m., and (e) said liquid comprising a dye having a viscosity of from about 600 to about 3030 c.p.s.

7. The method of applying liquid to the surface of a moving web in a randomly speckled pattern, which comprises (a) advancing said web continuously through a treating station, (b) distributing the liquid material over the surface of said web from a plurality of closely spaced distribution points across the width of said web, (c) said distributing step being carried out at each distribution point by flowing the liquid onto the surface of a rotating flat disc having a randomly irregular peripheral contour, whereby said liquid is atomized by centrifugal force into droplets of random size and is discharged from said discs at randomly varying radial and tangential velocities.

8. A method according to claim 7, further characterized by (a) the diameter and rotational speed of said discs being so correlated with the viscosity of said liquid and the spacing of said distributor points as to assure substantial overlapping of the distributional patterns of adjacent discs.

* * * * *